United States Patent [19]

Maggos et al.

[11] 4,037,375

[45] July 26, 1977

[54] MULTI-STORY FLOOR-CEILING SYSTEM AND METHOD

[76] Inventors: Theodore Maggos, 509 E. 72nd St., New York, N.Y. 10021; David H. Geiger, Kirby Lane, Rye, N.Y. 10580; Sheldon M. Steiner, 184-61 Tudor Road, Jamaica, N.Y. 11432; Henry D. Gregorio, 12 Deepdale Court, Glencove, N.Y. 11542

[21] Appl. No.: 605,666

[22] Filed: Aug. 18, 1975

[51] Int. Cl.[2] ..... E04B 5/48; E04B 5/36; E04B 1/16

[52] U.S. Cl. ..... 52/220; 52/320; 52/334; 249/26; 264/35; 264/228

[58] Field of Search ..... 52/319–326, 52/220, 221, 607, 329, 341, 327, 741, 334, 335, 144, 145, 576, 577, 336, 436, 437, 332, 333, 374; 249/26–31; 264/35, 228

[56] References Cited

U.S. PATENT DOCUMENTS

| | | | |
|---|---|---|---|
| 1,221,151 | 4/1917 | Davis | 52/336 |
| 1,338,567 | 4/1920 | Flynn | 52/341 |
| 1,846,195 | 2/1932 | Goldsmith | 249/29 |
| 1,846,197 | 2/1932 | Goldsmith | 52/329 |
| 2,775,019 | 12/1956 | Bemis | 52/327 |
| 2,916,909 | 12/1959 | Miller | 52/577 |
| 3,030,687 | 4/1962 | Muspratt | 52/607 |
| 3,245,186 | 4/1966 | Jentoft | 52/334 |
| 3,394,514 | 7/1968 | Lindner | 52/334 |
| 3,417,191 | 12/1968 | Fork | 52/221 |
| 3,619,959 | 11/1961 | Parker | 52/326 |
| 3,908,323 | 9/1975 | Stout | 52/221 |

FOREIGN PATENT DOCUMENTS

| | | | |
|---|---|---|---|
| 1,085,163 | 7/1954 | France | 52/322 |
| 1,357,510 | 2/1964 | France | 52/323 |
| 887,692 | 5/1956 | Norway | 52/221 |

*Primary Examiner*—James L. Ridgill, Jr.
*Attorney, Agent, or Firm*—Donnelly, Maky, Renner & Otto

[57] ABSTRACT

A floor-ceiling system for multi-story buildings which utilizes a bottom membrane having significant tensile strength supported on the building frame, such membrane being either cast in place and supported by shoring or prefabricated and self-supported, with void-producing duct forms regularly arranged and supported on the membrane, and a poured-in-place plastic material covering the membrane and duct forms to create structural elements alternating with the duct forms to form a substantially finished floor-ceiling system when the plastic material cures. The duct forms may be provided with access openings to the floor or ceiling or with lateral access openings interconnecting each other. The duct forms may be left-in-place forms or inflatable tubes removed when deflated after the material cures. Finishing materials for the floor or ceiling such as carpeting or acoustical tile may be secured directly to the essentially planar bottom or top surface of the system.

16 Claims, 4 Drawing Figures

MULTI-STORY FLOOR-CEILING SYSTEM AND METHOD

This invention relates generally as indicated to a multi-story floor-ceiling system and method and more particularly to a floor-ceiling system which may combine some of the advantages obtained by conventional, pre-cast or prefabricated construction with some of the advantages obtained by a poured-in-place construction.

In conventional, poured-in-place concrete construction, concrete is poured over formwork which may take the form of plywood or pans. The formwork or pans are removed after the concrete sets, and if pans are employed, the bottom of the concrete is embossed with the pattern of the pans. Normally, heating, ventilating or air conditioning ducts are suspended beneath the slab and hidden by means of a suspended ceiling.

Wiring or plumbing conduits may also be suspended from the slab or may be embedded in the slab as dictated by the plans and specifications.

In poured-in-place construction, the pans are normally used to lighten the dead weight of the concrete slab. Also employed for the same purpose are a variety of tubular forms such as paper tubes which are placed over the formwork. The voids created by the forms are used principally to lighten the weight of the concrete. In either case, temporary formwork must be employed, and complete flexibility of utility ducting is not available.

In pre-cast construction, wherein temporary formwork is not usually required, shapes in the forms of slabs, Tees, or double Tees are often employed. Exposed or enclosed voids are employed to lighten the pre-cast units and such may be used for utilities. However, the principal reason for such voids is to lighten the unit. Moreover, such units must of a cost necessity be nearly all identical to achieve the required economies for pre-cast units which are made either at a plant site or at the construction site from special patterns.

Combinations of prefabricated and poured-in-place systems have been employed. The most common is the use of a metal deck over which concrete is poured. Such metal deck may incorporate cells for electrical wiring, but such cells have been unsuccessfully used for air distribution. Moreover, the position of the cells is dictated by the mechanical and electrical design and specifications, and such cells are not employed in combination with the remainder of the system to optimize the distribution of the concrete nor to take advantage of the tensile capabilities of the metal deck.

Relatively thin reinforced concrete forms have been used in place of the metal deck with concrete again being poured over the top. Wiring or utility ducts may be embedded in such poured concrete, but again the ducts are not arranged nor designed to optimize the structural compressive qualities of the concrete nor the tensile qualities of the thin concrete form. The advantages of a metal deck system or a system using a thin concrete form is to avoid the temporary formwork required.

In contrast to the above, the system and method of the present invention utilizes a combination of a prefabricated bottom membrane, a core of continuous strategically arranged void-products, and a poured-in-place plastic material surrounding such ducts which optimizes in the system the tensile strength of the membrane and the compressive strength of the plastic material.

Access to the ducts from the floor or ceiling of the system may be provided as required, thus making the ducts useful not only in the design formation of the poured-in-place material, but also as mechanical, electrical or air ducts.

In somewhat more detail, the present invention comprises a bottom membrane which may be a prefabricated strip of material with a high tensile strength such as steel or relatively thin reinforced concrete. A core of strategically and regularly arranged void-producing duct forms are supported on the membrane. Such duct forms are designed to make available mechanical, electrical or air conduits, but are also designed to form the poured-in-place plastic material, such as concrete or gypsum, into main structural elements of the system alternating with the forms, such elements determining the structural properties of the system. The poured-in-place material which is poured over the ducts, between the ducts and over the bottom membrane, after setting, becomes keyed to the bottom membrane and stabilizes the entire composite structure so as to behave as a single integrated substantially finished structural element.

It is a principal object of the present invention to provide a floor-ceiling system having a minimum of dead weight and an optimum weight-strength ratio.

Another principal object is the provision of a floor-ceiling system in which a substantially completed continuous network of mechanical, electrical or other service ducts is utilized as the formwork for the poured-in-place material.

Another important object is the provision of such floor-ceiling systems in which the continuous network of services can be fully installed, tested and made operable prior to pouring of the plastic material.

Another object is the provision of a floor-ceiling system for multi-story buildings which utilizes a bottom membrane having significant tensile strength with a void-producing ductwork core supported on the membrane and regularly arranged, so that a poured-in-place plastic material covering the membrane and ductwork creates a regular arrangement of structural elements alternating with the ductwork when the plastic material cures.

Yet another object is the provision of a method of forming a floor-ceiling system for multi-story buildings which includes the steps of placing or forming a bottom tensile membrane on the frame of the building, regularly arranging void-producing forms on the membrane, and then covering the membrane and forms with a poured-in-place material to create structural elements alternating with the forms and forming a substantially finished floor-ceiling system when the material cures.

A further object is the provision of a floor-ceiling system wherein such bottom membrane comprises laterally spaced metal strips with void-producing forms supported on and bridging such strips.

Still another object is the provision of such system wherein the forms may be left in place or removed following cure of the plastic poured-in-place material.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

In said annexed drawings:

FIG. 3 is a fragmentary vertical section showing another embodiment of the invention using a two-stage pour with the first forming the membrane.

Figures 1, 4, 5:
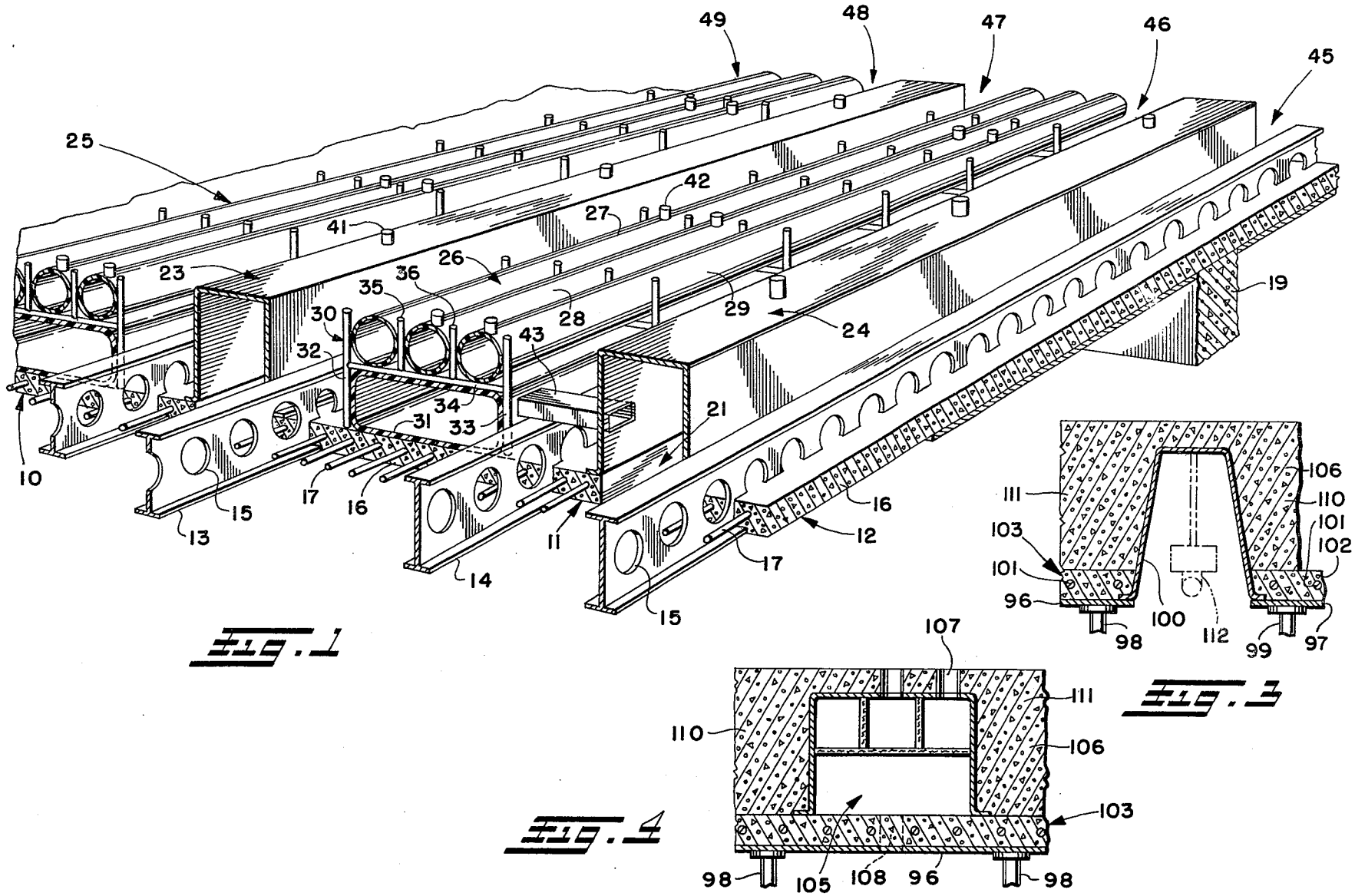
FIG. 1 is a cut-away perspective view of one embodiment of the present invention illustrating a concrete slab bottom membrane positioned on top of the horizontal components of the building frame and the core of continuous ductwork positioned for pouring of the plastic material thereover.
FIG. 4 is a fragmentary vertical section similar to FIG. 3 showing another form of ductwork which may be employed with the membrane of FIG. 1, or the two-stage pour embodiment of FIG. 3.

Referring now more particularly to FIG. 1, there is illustrated two components of the three-component system, namely, the bottom membrane and the ductwork supported thereon. In the FIG. 1 embodiment, the bottom membrane comprises relatively thin reinforced concrete slabs which are illustrated at 10, 11 and 12, each of which has embedded therein, laterally spaced elongated reinforcing members 13 and 14. In FIG. 1, such reinforcing members are in the form of rolled I-beams having uniformly spaced weight reducing apertures 15 in the web thereof. Other shapes of structural members may be employed such as those having channel, T or Z sectional configurations. Also, truses may be employed.

Such structural elements serve several purposes. They ensure the rigidity of the slabs for handling and transportation purposes. In addition to strengthening such slabs, they also serve as upwardly projecting keys to integrate the membrane with the poured-in-place material and also to strengthen the structure elements formed by the poured-in-place material.

At a remote plant site or adjacent the building site, a thin layer of concrete indicated at 16 is poured into a pattern having a planar bottom surface, partially embedding the structural members 13 and 14, and additional more closely spaced reinforcing elements such as reinforcing bars or cables are embedded in the concrete as indicated at 17. Such reinforcing elements 17 may be prestressed or post-tensioned.

The prefabricated panels above described comprise the bottom membrane which has considerable tensile strength and sufficient rigidity to support the core of ductwork constructed thereon and the poured-in-place material which will cover both the membrane and the ductwork.

When the construction of the prefabricated panels is completed, they are hoisted into position to be supported on the horizontal components 19 of the building frame. The membrane panels are preferably mounted on the frame or beam 19 to span between such frame member and another frame member, although it will be appreciated that such membrane panels may be supported at their ends by shoring and butt joined to each other. Also, the membrane panels are preferably spaced slightly laterally from each other to form a gap as indicated at 21. For a given floor, the membrane panels will extend parallel to each other, uniformly laterally spaced, and aligned from one exterior wall of the building to the other. The membrane panels may be mechanically joined to membrane panels butted thereagainst as by bridge splices on the reinforcing members 13 and 14.

The dimensions of the membrane panels may vary depending upon the application. For example, the concrete slab may be on the order of two inches thick, while the height of the reinforcing members 13 and 14 from bottom to top flange may be on the order of six inches. The width of the membrane panels, at such noted dimensions, may be on the order of approximately six feet and of a length on the order of forty feet. Such dimensions may, of course, vary depending upon the applications.

When the membrane panels are thus erected on the building frame 19, a core of void-producing duct forms is then mounted on the bottom membrane. Such forms are preferably regularly laterally spaced and extend continuously from outside wall of the building to the opposite outside wall of the building where they may be joined by suitable header ducts connecting the same to a utility column.

In FIG. 1, there are illustrated two types of forms. Bridging the lateral edges of the membrane panels are inverted U-shape forms 23 and 24. Such forms may be constructed of sheet metal, plywood, fiberglass, or gypsum board material.

Centered between the U-shape forms 23 and 24 are multi-duct, void-producing forms shown generally at 25 and 26. In the embodiment of FIG. 1, the duct forms 25 and 26 are identical in form, and accordingly only the duct form 26 will be described in detail. The duct forms are shown in the form of pressurized tubes 27, 28 and 29 which may be supported on rod or wire stanchions shown generally at 30. Such stanchions support the three smaller tubes 27, 28 and 29 over the top of a relatively larger tube 31. When inflated, the tubes will be relatively stiff, but the stanchions serve to maintain the tubes in place during the pour. The stanchions may be embedded in the floor and include two lateral uprights 32 and 33 interconnected by bridge member 34. Separators 35 and 36 extend upwardly from the bridge members separating the tubes 27 and 28, and 28 and 29, respectively.

Relatively short paper tubes may be positioned on the duct forms as indicated at 41 and 42 to provide access from the duct forms to the floor surface above after concrete or other plastic material is poured over the forms. Also, as indicated at 43, the duct forms may be interconnected by lateral passages where desired. The access forms 41 and 42 will, of course, have their top edges level with each other to form access openings in the floor above.

When the formwork is thus completed, a pourable, stabilizing curable material is poured over the forms to the level of the top edge of the access forms 41 and 42. Such material will usually take the form of concrete, although other material may be used such as gypsum or plaster.

When the plastic material sets, the duct form tubes 27, 28, 29 and 31 may be deflated and removed from the cured pourable material. The forms 23 and 24 may also be removed, if desired, or may be left in place.

The duct forms 25, 23, 26 and 24, reading from left to right in FIG. 1, serve three important purposes. The first is that they provide a regular network of cells or ducts which can be of any length since they run over the beams 19. Such cells may be laterally interconnected and connected through to the ceiling below or the floor above as desired. Such cells may be for mechanical, electrical or heating, ventilating and air conditioning use. The second important purpose of the ducts is to minimize the amount of poured-in-place material required. Since concrete weighs approximately 140 pounds per cubic foot, the relatively large voids created by the ducts substantially reduce the amount of concrete required and thus reduce the dead weight of the floor-ceiling system. Finally, and perhaps most importantly, the regular spacing of the ducts on the membrane creates therebetween forms to receive the poured-in-place plastic material or concrete to form structural elements in the floor-ceiling system extending transversely of the supporting beam 19. Reading from right to left in FIG. 1, the forms creating such structural elements are shown at 45, 46, 47, 48 and 49.

The reinforcing members 13 and 14 of the bottom membrane are designed to project upwardly into the center of such forms, and when the poured-in-place material is poured over the membrane and the forms, the reinforcing members serve to strengthen the structural elements thus formed. If the reinforcing members are of sufficient strength, no additional reinforcing members such as reinforcing bar or post-tension wires need be employed. For many applications, the only additional reinforcement required in the poured-in-place material would be a wire mesh extending over the tops of the forms. In any event, the forms are regularly arranged to create with the poured-in-place material structural elements alternating with the forms to form a substantially finished floor-ceiling system when the poured-in-space material cures. Since the bottom of the membrane is essentially planar, and since the top of the poured-in-place material will be essentially planar, acoustical tile may be secured directly to the bottom of the system and carpeting secured to the top of the system.

The spacing of the structural elements provided by the forms, as well as the size and number of ducts provided by the forms, may vary greatly. In the FIG. 1 embodiment, illustrating three smaller top ducts and one large bottom duct formed by the duct forms 26, such an arrangement may be suitable for office buildings. Simpler forms may be employed in connection with apartments or motels, but in the case of hospitals, for example, forms having many more ducts may be required.

Figure 2:
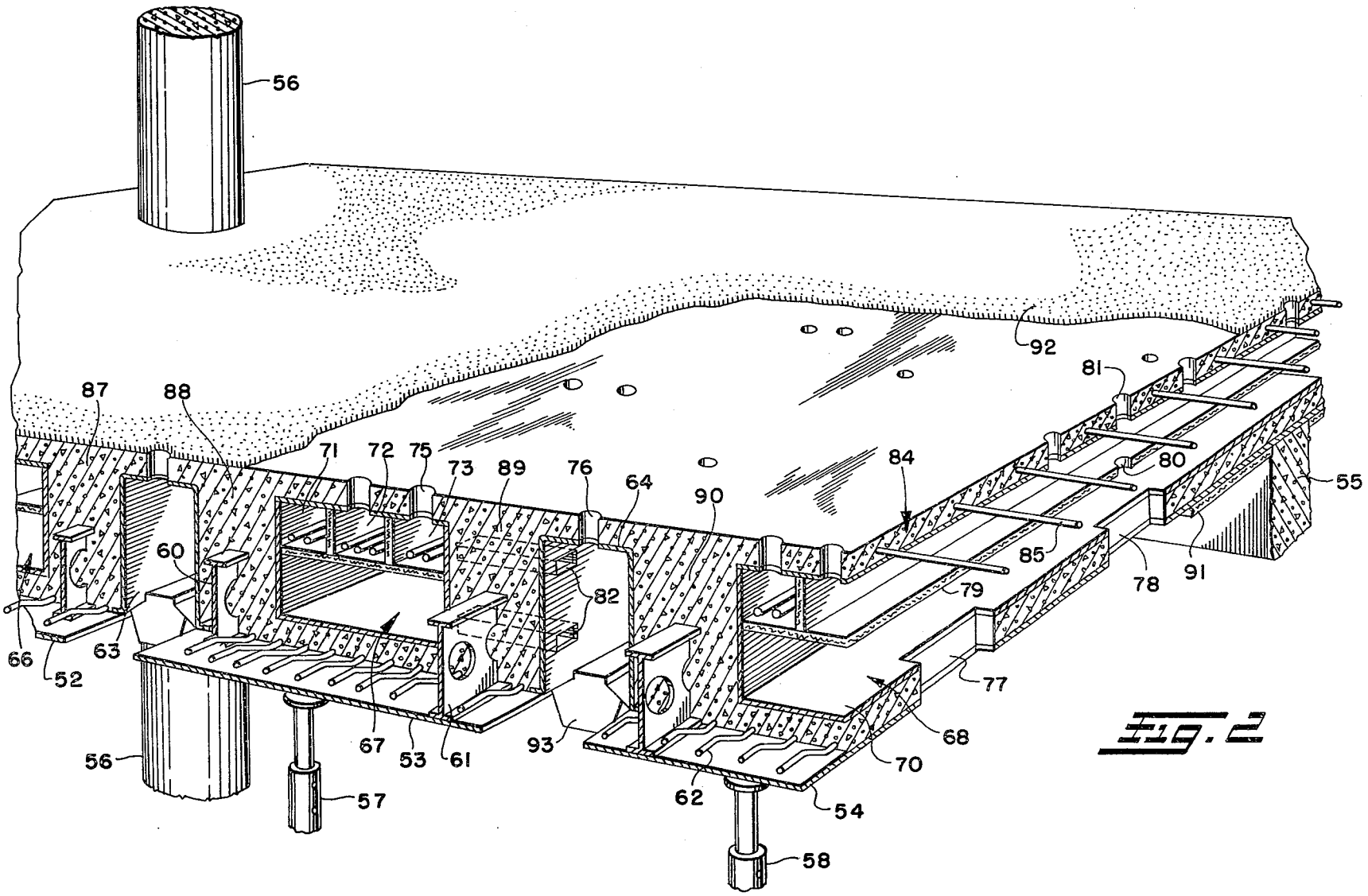
FIG. 2 is a perspective view similar to FIG. 1 but illustrating a metal plate or strip form of membrane and slightly different ductwork forms, but showing the system essentially finished.

Referring now to FIG. 2, there is illustrated yet another form of the present invention.

In FIG. 2, the bottom membrane comprises metal plates or strips indicated at 52, 53 and 54 which are supported on top of beam 55 in turn supported from column 56. Such metal plates are relatively stiff and are supported from the floor below by suitable shoring indicated at 57 and 58. Such plates may have secured to the top thereof reinforcing members 60 and 61 similar to the reinforcing members 13 and 14 of the FIG. 1 embodiment. With such membrane strips supported on the building frame 55 as indicated, reinforcing rods or wires 62 may be positioned over the top surfaces thereof. Again, such reinforcing rod or wire may be prestressed or post-tensioned. the reinforcing 62 may be secured to the top surface of the strips.

The membrane strips are again preferably laterally spaced with elongated, continuous, inverted U-shape forms 63 and 64 bridging the gaps therebetween. Centered on such membrane strips are multi-duct forms 66, 67 and 68. Such duct forms may be prefabricated of sheet metal, plywood, plastic, wall board, and the like, and are supported respectively above the bottom membrane metal plates 52, 53 and 54, as indicated. As in FIG. 1, such duct forms may provide a large bottom duct 70 and three relatively smaller top ducts 71, 72 and 73. Also, with suitable forms, the ducts may be provided with access to the floor above as indicated at 75 and 76 or to the ceiling below as seen at 77 and 78. The access passages 77 and 78 may be utilized for diffusers if the large bottom duct 70 is employed for the distribution of air. The center wall of the duct 79 dividing the large bottom duct from the three smaller top ducts may be provided with a passage indicated at 80 aligned with passage 78 and passage 81 thereabove. In this manner, through access is possible. As in the FIG. 1 embodiment, lateral access between the ducts may also be provided as seen at 82.

With the forms properly positioned, the utility, electrical and heating, ventilating or air conditioning ducts may be connected and tested before the poured-in-place plastic material 84 is poured. This procedure would, of course, save costly alteration in the structure after the poured-in-place material cures.

With the forms in position, the poured-in-place material is then poured over the forms and flows over the top of the high tensile bottom membrane and completely surrounds the forms. Again, preferably, some top reinforcement as indicated at 85 is provided which may be in the form of reinforcing bar or preferably, wire mesh. The structural elements alternating with the forms which are formed by the forms from the poured-in-place material can be seen at 87, 88, 89 and 90. Such structural elements cooperate with the tensile capabilities of the bottom membrane and the compressive capabilities of the poured-in-place material to form the weight carrying load of the system. The large void-producing forms considerably lighten the dead load of the system.

In the embodiment of FIG. 2, the structural members 60 and 61 need not be employed, but if they are not, usually some additional reinforcing will be employed in the structural elements 87, 88, 89 and 90.

Because of the essentially planar nature of the bottom surface of the metal plates 52, 53 and 54, an acoustical ceiling seen at 91 may be secured directly to the bottom of the membrane. Also, carpeting may be provided directly on top of the poured-in-place material as indicated at 92.

In FIG. 2, the forms 66, 67 and 68 will be left in place, but as in FIG. 1, the forms 63 and 64 may either be left in place or removed. The cavities formed by the forms 63 and 64 may vary in shape and can be finished or exposed to view. Also, such cavities can house a wide variety of light fixtures such as illustrated at 93. Such light fixtures may be used in combination with air diffusers.

When the poured-in-place plastic material 84 cures, the shoring 57 and 58 can be removed since the poured-in-place material will be keyed to the bottom membrane forming an integral structural unit.

As in FIG. 1, because the floor-ceiling system is positioned over the main frame 55, the ducts formed in the system can be of any length desired and can run from one outside wall of the building to the other.

Referring now to FIGS. 3 and 4, there is illustrated yet another form of the present invention. Referring first to FIG. 3, temporary formwork such as plywood indicated at 96 and 97 is supported from the floor below by shoring seen at 98 and 99. Such temporary formwork is preferably in the form of elongated strips employed for the metal plates of the bottom membranes in FIG. 2. Such formwork may abut against the top edge of the horizontal beams of the building frame. Such strips are laterally spaced and bridging such strips are inverted U-shape forms 100 which are of a slightly different shape than the bridging forms shown in FIGS. 1 and 2. Positioned over such formwork are reinforcing members 101 which again may be in the form of reinforcing bar or prestressed or post-tensioned members. Over each strip of formwork there is then poured a relatively thin layer of concrete indicated at 102, which, when it sets, forms bottom membrane 103. Since concrete will harden overnight to the point where it can be walked upon, shortly after the formation of such membrane, ductwork indicated at 105 may be then positioned on such membrane. Such ductwork is preferably positioned in the center of the temporary form strips and the membrane strips formed thereon alternating with the forms 100. The form 105 may be similar to the form 67 employed in FIG. 2, but need not be provided with a bottom wall. With the forms 105 in place, concrete or like plastic material 106 is poured thereover covering the bottom membrane and the forms 105 and 100. Again, access to the floor above may be provided through passages 107 and to the ceiling below by passages 108. When the plastic material 106 cures, the shoring 98 and 99, as well as the temporary forms 96 and 97, are removed. The poured-in-place concrete or plastic material 106 forms structural elements 110 and 111 alternating with the forms as in the other embodiments of the present invention. Such structural elements may, if required, be provided with additional reinforcing. Again, a wire mesh may be provided over the tops of the forms as the poured-in-place material is positioned.

FIG. 3 illustrates a form of lighting fixture 112 which may be used in connection with the exposed form 100.

Whether the bottom membrane is prefabricated or formed at the job site, it may contain suitable anchors or other fastening devices which will permit the subsequent installation of ceilings, either flush with the bottom surface of the membrane, or suspended, lights, and other accessories. Moreover, such bottom membrane may contain openings, to permit ceiling access into ducts or through access as indicated in FIG. 2.

The bottom membrane strips, whether prefabricated or formed in place, are constructed so as to span over the main structure of the building such as the beams illustrated, and are preferably laterally spaced so that there is a gap of several inches between them. After the installation of the strips, the central core is prepared, and such core is created by the selective flow of the plastic poured material by the strategic arrangement of the duct forms over the bottom membrane. Such forming devices can be of any sheet material or inflated pressurized devices of the desired shape, as in FIG. 1. Accordingly, the forming devices can be removable or they can be left in place after the poured material sets. If left in place, they act as a lining for a given duct.

It will be understood that the shape and construction of the forming devices may vary considerably, but such forming devices create not only the available utility ducts, but also reduce the dead weight of the system. Most importantly, they strategically form the poured-in-place material to create structural elements alternating with the forms and cooperating with the high tensile bottom membrane to form the complete system.

After all of the components of the core are installed, and preferably, after all connections to the mechanical and electrical distribution ducts are made so as to form a continuous operable network, the plastic material is poured thereover. The poured plastic material may be concrete, gypsum, or other free-flowing substance which can fill all of the spaces not occupied by the forming devices, and which will harden into a monolithic material after a given time. The poured-in-place plastic material may contain a variety of reinforcing material such as steel, fibers, wire meshes, etc. Such plastic material, once it penetrates all of the voids, and after it sets, and in spite of the various cavities, ducts, etc., when they are strategically located, causes the entire system of components to act as an integrated, rigid structure.

The shape, depth, etc. of the poured material is determined solely by the core forming devices, and as such, the size and shape of the ducts will determine the shape of the structural cross-section of the system which in turn will effect its structural qualities.

Although not all of the duct forms may be utilized in a utility distribution network, such network is nonetheless provided and easy access openings from both the top and bottom are present. The regular network of ductwork reduces the required poured-in-place material to a minimum and, in effect, provides a useful, though not necessarily used, network of ducts to replace all non-working structural material.

Since the system is supported on top of the frame of the building, the ductwork may be continuous and of any length desired.

We, therefore, particularly point out and distinctly claim as our invention:

1. A floor-ceiling construction for multi-story buildings, comprising: a bottom membrane having significant tensile strength, said membrane including laterally spaced strip elements, void-producing ductwork supported on said membrane and regularly arranged creating with said membrane a form, said ductwork including ducts open at the bottom ridging the lateral space between said strip elements, a poured-in-place plastic material encasing said form, said poured-in-place plastic material including a regular arrangement of structural elements alternating with said ductwork, and said bottom membrane including upwardly projecting elongated keying elements between said ductwork adapted to integrate said membrane with said poured-in-place material and increase the strength of said structural elements when said poured-in-place material cures.

2. A construction as set forth in claim 1 wherein said bottom membrane comprises a self-supporting panel.

3. A construction as set forth in claim 1 wherein said bottom membrane comprises shoring supported metal strips, and structural element reinforcing members extending parallel to said ductwork to strengthen said structural elements when said plastic material cures.

4. A construction as set forth in claim 1 wherein said bottom membrane is a thin layer of reinforced concrete with said keying elements partially embedded in said thin layer.

5. A construction as set forth in claim 1 wherein said ductwork includes a plurality of adjacent ducts.

6. A construction as set forth in claim 1 including vertical access passages from the floor above and the ceiling below to said ductwork and horizontal access passages extending through said structural elements to interconnect said ductwork on each side thereof.

7. A flooring construction as set forth in claim 1 wherein the bottom surface of said bottom membrane is essentially planar, and an acoustical ceiling secured directly thereto.

8. A method of forming a floor-ceiling construction for multi-story buildings comprising the steps of forming a bottom membrane by laterally spacing bottom tensile membrane strip elements on the frane of a building wherein said strip elements include upwardly projecting elongated keying elements, regularly arranging void-producing ductwork on such membrane strip elements, some of which bridge the gaps between membrane strip elements and creating therewith a form, and covering such form with a plastic material to create structural elements alternating with said ductwork to form a substantially finished floor-ceiling system when such plastic material cures.

9. A method of claim 8 including the step of constructing such membrane to be self supporting.

10. A method of claim 8 wherein such bottom membrane is formed by a precast concrete slab having said keying elements partially embedded therein.

11. The method of claim 8 wherein such bottom membrane is formed by a first stage pour over removable forms.

12. The method of claim 8 including the step of providing access passages from the floor and ceiling to such void-producing ductwork and access passages between such void-producing ductwork.

13. The method of claim 8 including the step of securing an acoustical ceiling directly to the underside of such bottom membrane.

14. A method of claim 8 including the step of placing reinforcing members between such forms to strengthen such structural elements.

15. A method of claim 14 wherein such reinforcing members are a part of such membrane projecting upwardly therefrom.

16. A method of claim 8 including the step of shore supporting such tensile membrane.

* * * * *